United States Patent [19]

Martin et al.

[11] Patent Number: 4,825,909

[45] Date of Patent: May 2, 1989

[54] HIGH PRESSURE HYDRAULIC FLOW CONTROL VALVE

[75] Inventors: Paul H. Martin; John C. Martin, both of Toronto; Roy G. R. Furzer, Willowdale, all of Canada

[73] Assignee: Diesel Equipment Limited, Toronto, Canada

[21] Appl. No.: 159,737

[22] Filed: Feb. 24, 1988

[51] Int. Cl.[4] ..... F15B 13/042

[52] U.S. Cl. ..... 137/879; 91/452; 37/596.12; 37/599.2; 37/881; 298/22 C

[58] Field of Search ..... 91/452; 137/596.12, 137/599.2, 879, 881; 298/22 C

[56] References Cited

U.S. PATENT DOCUMENTS 3,878,864 4/1975 Schurger ..... 137/596.13
4,182,534 1/1980 Snyder ..... 298/22 C

FOREIGN PATENT DOCUMENTS 1017793 12/1952 France ..... 137/596.12
55-19690 2/1980 Japan ..... 298/22 C
55-86906 7/1980 Japan ..... 298/22 C
362930 8/1962 Switzerland ..... 298/22 C

*Primary Examiner*—Gerald A. Michalsky
*Attorney, Agent, or Firm*—Fetherstonhaugh & Co.

[57] ABSTRACT

A high pressure hydraulic flow control valve is formed with a spool which is capable of operating as a conventional spool to control the flow of fluid from an input port to an output port or to a return port. The spool also provides overload protection which will permit fluid to pass from the input port directly to the return port when an overload pressure condition exists in the fluid supply line. In alternative structure, the overload pressure release system may be incorporated into the valve which is used to control the return of fluid from the output port to the return passage. The high pressure hydraulic flow control valve is formed from a die-cast housing and has hardened seats mounted in access passages so as to bear against a seating shoulder. Preferably, a retaining sleeve is mounted in the access passage to bear against the hardened seat to retain it against the seating shoulder.

2 Claims, 8 Drawing Sheets

HIGH PRESSURE HYDRAULIC FLOW CONTROL VALVE

Figure 2:
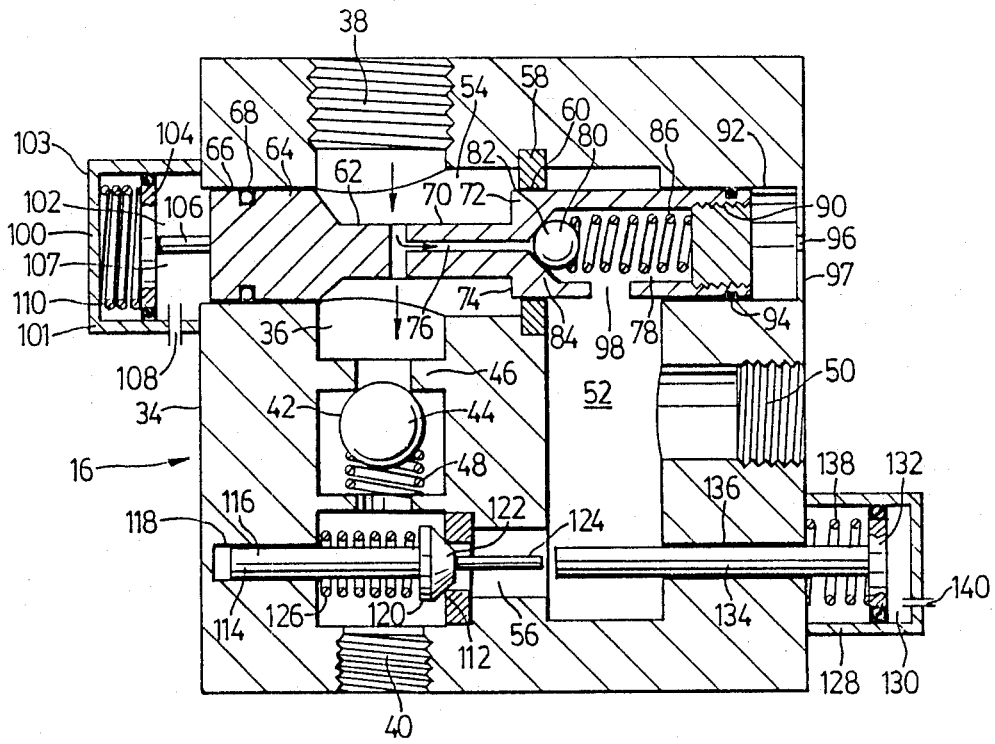

This invention relates to high pressure hydraulic valves. In particular, this invention relates to an overload protection system for use in high pressure flow control valves. In addition, this invention relates to high pressure hydraulic flow control valves in which the valve housing is die-cast and in which hardened valve seats are mounted in the housing after it is cast.

Considerable difficulty has been experienced in attempting to design high pressure hydraulic flow control valves which are compact. Difficulty has also been experienced in designing high pressure hydraulic flow control valves in which the valve housing is die-cast, compact and capable of withstanding very high pressures.

In an attempt to overcome the problems encountered when the pressure in the hydraulic fluid which is supplied to the control valve is excessive, overload flow controls have been added to flow control valves. These overload flow control systems have, however, been bulky and difficult to incorporate into the valve assembly.

It is an object of the present invention to incorporate an overload flow control system into a high pressure flow control valve.

The use of die-casting techniques in the manufacture of a valve housing offers the possibility of minimizing the extent of machine which must be carried out in order to finalize the production assembly. Die-cast housings are, however, made from a metal alloy which is not sufficiently hard to permit valve seats to be formed at an integral part thereof. Difficulty has been experienced in providing valve seats in valve passages of a die-cast valve housing.

It is an object of the present invention to provide for the simple and inexpensive installation of a hardened valve seat in a die-cast housing of a high pressure control valve.

According to one aspect of the present invention, a hydraulic flow control valve comprises a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, an overload flow passage opening through said flow control spool and having a first end communicating with said flow control passage and a second end communicating with said bi-pass passage, a second one-way check valve mounted in said overload flow control passage of said flow control spool for movement between a first position closing and a second position opening said overload flow control passage such that when the hydraulic pressure in said flow control passage exceeds a predetermined level, the second one-way check valve will move to its open position to allow the hydraulic fluid to flow from the fluid control passage to the return passage through the overload flow passage.

According to a further aspect of the present invention, there is provided a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, retrurn passage means communicating between the flow control passage and the dischrage passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, an overflow chaamber in said spool, an overflow passage extending through said spool and having an input end communicating with said flow control passage and an output end communicating with said overload chamber, a discharge passage opening from said overload chamber to said return passage, said output end of said overload passage having a first cross-sectional area (A1), an overload valve in said overload chamber comprising a guide shaft which is aligned with and sapced from the output end of said overload passage, said guide shaft having a second cross-sectional area (A2) which is less than the first cross-sectional area (A1), a sleeve member having a bore extending therethrough, said sleeve member being mounted on and extending radially from said guide shaft to provide a combined cross-sectional area which is greater than said first cross-sectional area (A1), said guide shaft slidably supporting said sleeve member in a sealed relationship for movement thereon between a first position in which it cooperates with the guide shaft to close the output end of the overload passage and a second position in which it is spaced from the output end of the overload passage to permit flow through the overload passage, spring means in said chamber normally urging said sleeve to its first position until the pressure in the flow control passage is sufficient to apply a load to the sleeve which is sufficient to cause it to move from said first position to said second position to open the overload passage into the overload chamber.

According to yet another aspect of the present invention, there is provided a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, said flow control spool comprises a head portion which is slidably mounted in said housing at one side of said flow control passage and a shaft portion extending from the head portion across the flow control passage and having an extension of reduced cross-sectional area extending through said flow control seat into the bi-pass passage, said flow control seat being in the form of a cylindrical passage, said flow control valve being slidably mounted on said extension of said spool so as to be located within said cylindrical passage when in said first position and being spaced outwardly from said cylindrical passage with respect to said flow control passage when in said second position, flow control valve return spring means normally urging said flow control valve to its first position, said head portion having a cross-sectional area (A1) which is greater than the cross-sectional area (A2) of said extension of said shaft portion such that when the pressure (P1) in the flow control passage times the difference in cross-sectional area A1 minus A2 is greater than the load applied by the flow control valve return spring, the flow control valve will move from its closed position to its opened position to permit the hydraulic fluid to pass from the flow control passage to the return passage to thereby relieve the overload condition.

According to a still further aspect of the present invention, there is provided a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, said flow control valve comprising shaft having a first end and a second end, a head portion at said first end of said shaft which is arranged to bear against said return flow control seat, a compression chamber formed in said housing on one side of the flow control passage opposite said return flow seat, a collar projecting radially from and slidably mounted on said shaft of said flow control valve, said collar being slidably mounted in said compression chamber, first spring means extending between said collar and said head normally urging said head toward said return flow seat to close said return flow passage, second spring means located in said compression chamber and extending between said collar and said housing for resisting inward movement of said collar into said chamber, the cross-sectional area of said collar (A1) being substantially greater than the cross-sectional area (A2) of the shaft such that when the pressure in the flow control passage exceeds a predetermined pressure, it will deflect the collar inwardly of said compression chamber to compress said second spring and as a consequence, the head portion of the flow control valve will move to open said return passage so that the excess pressure in the flow control passage can be reduced by permitting the flow of fluid through the return passage.

According to a further aspect of the present invention, there is provided a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, said flow control spool comprising a cylindrical head portion, a flow control stem projecting from one end of said head portion, a support shaft projecting from said stem, the stem being arranged to extend into sealing engagement with the flow control seal to function as said flow control valve to close the bi-pass passage when seated therein and to be withdrawn from the flow control seat to open the bi-pass passage, a chamber formed in said housing on the side of the flow control passage opposite the flow control seat, said chamber being adapted to slidably receive said head portion, said first pneumatic control means comprising a piston slidably mounted in said chamber and dividing said chamber into first and second compartments, air input passage means communicating with said second compartment to permit said second compartment to be pressurized to a predetermined pneumatic pressure, said head portion having a greater diameter than said stem portion such that when the pressure in the flow control passage exceeds a predetermined hydraulic pressure, the head portion will be driven into said chamber to compress said compression spring to a sufficient extent to withdraw the stem portion from said bi-pass seat, said shaft portion being smaller than the stem portion to permit the hydraulic fluid to pass through said bi-pass passage into said discharge passage, said compression spring being operable to re-seat the stem portion in said seat when the pressure in the flow control passage drops below said predetermined hydraulic pressure.

According to a still further aspect of the present invention, there is provided a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, said flow control spool comprises a cylindrical head portion, a stem having a first end connected to the head portion and a second end connected to a piston, the head portion being slidably mounted in a first chamber located on one side of the flow control passage and the piston being slidably mounted in a second chamber on the other side of the flow control passage, the head portion being arranged to extend into sealing engagement with the flow control seat to function as a flow control valve to close the bi-pass passage when seated therein and to be withdrawn from the flow control seat to open the bi-pass passage, means normally urging the head portion into sealing engagement with said seat, an overload flow passage opening through said housing from said flow control passage into said second chamber, a second one-way check valve mounted in said overload flow control passage for movement between a first position closing and a second position opening said overload flow control passage such that when the hydraulic pressure in said flow control passage exceeds a predetermined level, the second one-way check valve will move to its open position to allow hydraulic fluid to flow from the flow control passage to said second chamber so as to displace said piston and thereby move said head portion out of sealing engagement with said flow control seat to allow the hydraulic fluid to flow from the fluid control passage to the return passage through the bi-pass passage, bleed passage means formed in said housing and communicating between said second chamber and said discharge passage means to permit slow bleeding of hydraulic fluid from the second chamber to permit the head portion to return to sealing engagement with the flow control seat when the pressure in the flow control passage drops below the predetermined pressure required to open the second one-way check valve.

According to yet another aspect of the present invention, a valve comprises a die-cast housing having a flow control passage opening therethrough, a seating shoulder cast into said flow control passage of said housing, an access passage cast into said housing and opening from the seating shoulder through the housing in alignment with the seating shoulder, a hardened seat mounted in said access passage and bearing against said seating shoulder, said hardened seat having a through passage arranged in series with said flow control passage, a retaining sleeve mounted in said access passage and arranged to bear against said seat to retain said seat against movement away from said seating shoulder, said retaining sleeve having a through passage communicating with said flow control passage whereby fluid passing through said seat into said sleeve may be discharged into said flow control passage of said housing.

According to a further aspect of the present invention, there is provided a dye cast housing having a flow control passage opening therethrough, a seating shoulder cast into said flow control passage of said housing, an access passage cast into said housing and opening from the seating shoulder through the housing in alignment with the seating shoulder, a hardened seat mounted in said access passage and bearing against said seating shoulder, said hardened seat having a through passage arranged in series with said flow control passage, said hardened seat being proportioned to provide an interference fit within said access passage so as to permanently located in a position bearing against said seating shoulder.

Figure 1:
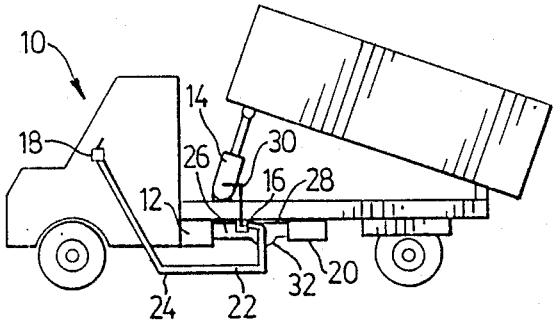

The invention will be more clearly understood after reference to the following detailed specification read in conjunction with the drawings wherein;

FIG. 1 is a diagrammatic representation of a dump truck of the type which employs a high pressure hydraulic flow control valve to control the supply of hydraulic fluid to its lifting hoist.

Figure 3:
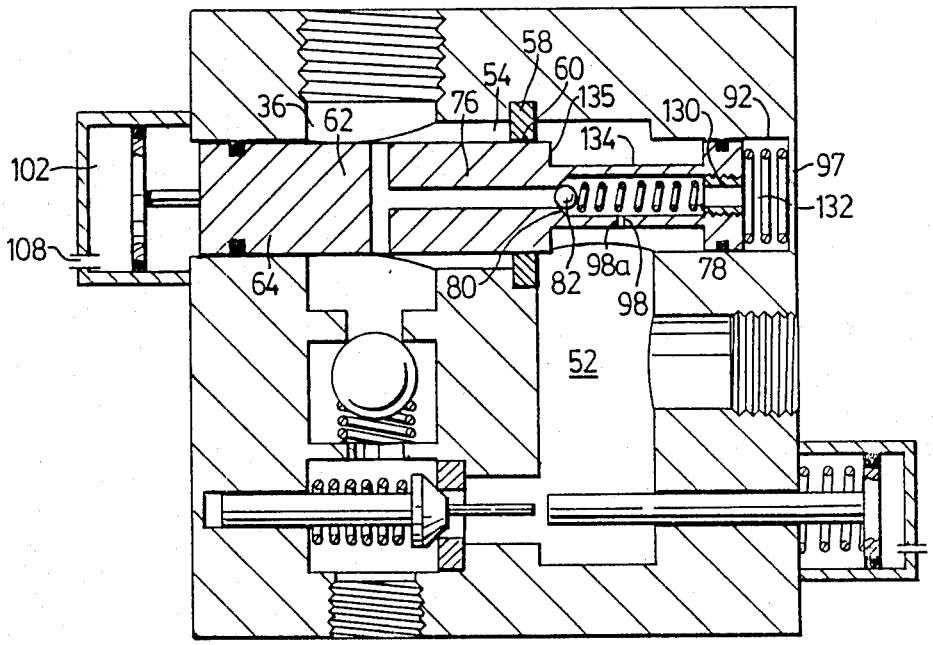
Figure 4:
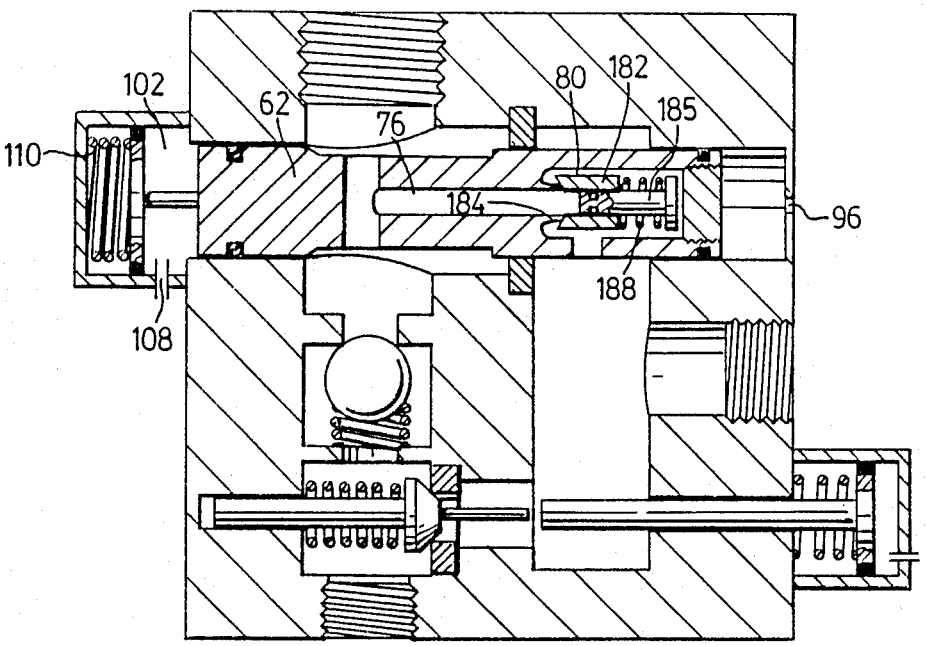
Figure 5:
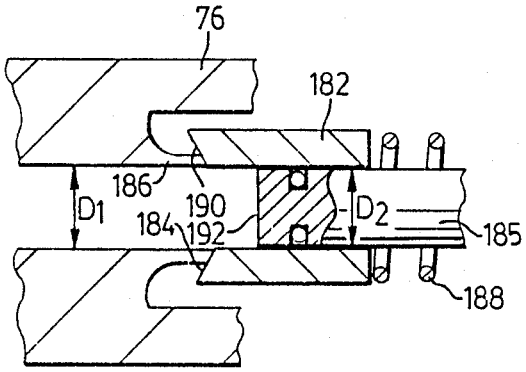
Figure 8:
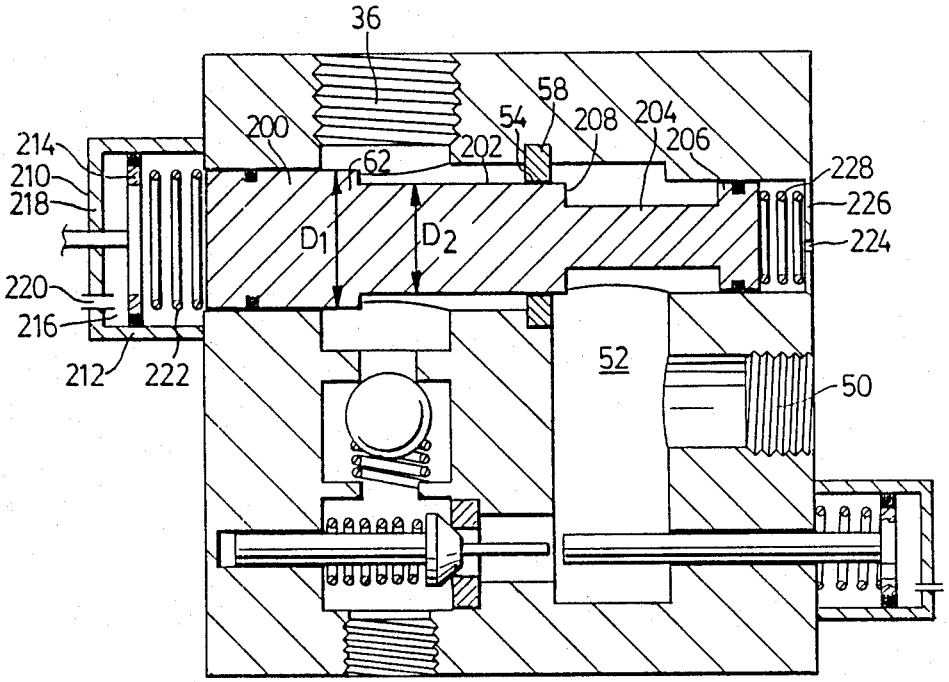
Figure 9:
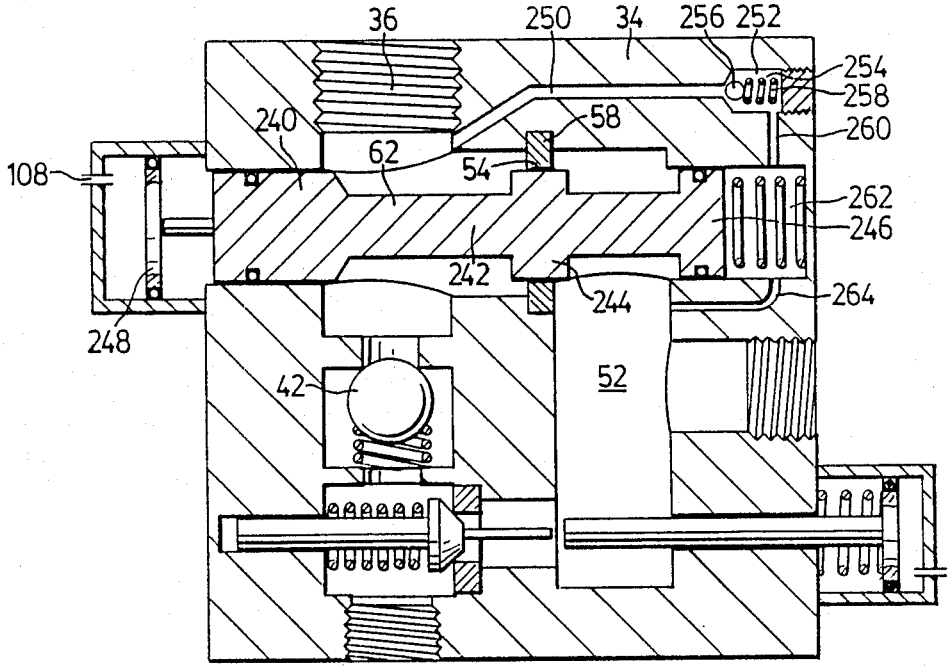
Figure 10:
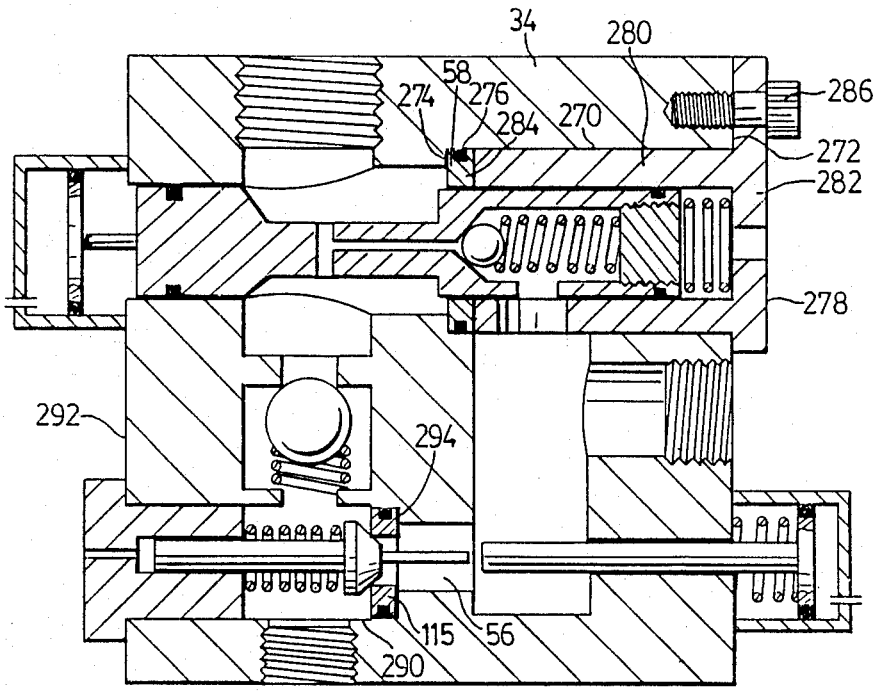

FIGS. 2, 3 and 4 are diagrammatic sectional side views of a high pressure hydraulic flow control valve constructed in accordance with an embodiment of the present invention, FIG. 5 is an enlarged detailed view of the overload check valve of FIG. 4, FIGS. 6 to 9 are sectional side views similar to FIG. 2 illustrating further embodiments of the present invention, FIG. 10 is a section side view of a flow control valve illustrating the manner in which hardened valve seats are mounted in a die-cast valve body.

With reference to FIG. 1 of the drawings, the reference numeral 10 refers generally to a dump truck of the type which has a hydraulic pump 12 which supplies hydraulic fluid to an extensible ram 14 through a high pressure hydraulic flow control valve 16. The hydraulic flow control valve 16 is operated by means of a pneumatic control valve 18. An hydraulic fluid storage tank 20 is also provided.

The pneumatic control valve 80 is connected to the hydraulic control valve 16 by means of pneumatic lines 22 and 24. The hydraulic control valve 16 is connected to the pump 12 by means of a conduit 26 and to the storage tank 20 by means of a conduit 28. A conduit 30 serves to connect the control valve 16 to the ram 14. A conduit 32 connects the pump 12 to the storage tank 20.

In use, hydraulic fluid is withdrawn from the storage tank 20 by the pump 12. The pump 12 supplies hydraulic fluid at high pressure to the hydraulic control valve 16 through the conduit 26. The control valve 16 can serve to extend, hold or contract the ram 14 and it incorporates an overload prevention system which serves to prevent overloading of the hydraulic system. When the ram is to be extended, the control valve 16 is used to direct the hydraulic fluid to the ram 14. When the ram is to be held in an extended position, this control valve traps hydraulic fluid in the ram and directs the fluid, which continues to be supplied by the pump, to the storage tank. When the ram is to be lowered, the control valve 16 connects the conduit 30 to the conduit 28 so that the hydraulic fluid is returned to the storage tank 20.

A high pressure hydraulic flow control valve 16 constructed in accordance with one embodiment of the present invention is diagrammatically illustrated in cross-section in FIG. 2 to which reference is now made.

The control valve 16 is formed with a housing 34. A flow control passage 36 opens through the housing 34 and has an input end 38 and an output end 40. In the insulation illustrated in FIG. 1 of the drawings, the input end 38 is connected to the pump 12 by means of a conduit 26 and the output end 40 is connected to the ram 14 by means of the conduit 30. A one-way check valve 42 is positioned in the passage 36 and consists of a ball 44 which is normally urged against a seat 46 by means of a compression spring 48. The one-way check valve 42 serves to permit hydraulic fluid to flow through the passage 36 from the input 38 to the output end 40 but serves to prevent flow of hydraulic fluid in the opposite direction. A discharge passage 50 opens from the housing 16 and communicates with the storage tank 20 through the conduit 28. A discharge compartment 52 is formed in the housing 16 and communicates with the discharge passage 50. A bi-pass passage 54 extends from the through passage 38 to the discharge chamber 52. A return passage 56 also extends from through passage 36 to the discharge chamber 52. A flow control valve seat 58 is located in the bi-pass passage 54 and is formed with a bore 60. A flow control spool 62 is slidably mounted in the housing 16. The flow control spool has a head portion 64 which is slidably mounted in the passage 66 which is located at one side of the flow control passage 36 and is sealed therein by means of an O-ring 68. The spool 62 also has a waist portion 70 of reduced diameter and a valve portion 72 which is proportioned to fit in a close fitting, sliding sealed relationship in the bore 60 of the valve seat 58 so as to prevent the passage of hydraulic fluid from the passage 36 into the discharge chamber 52 when the spool is in the position shown in FIG. 2 of the drawings. The spool 62 has a shoulder 74 which extends radially inwardly to the waist portion 70. An overload flow passage 76 extends from the flow control passage 36 through the spool to the discharge chamber 52. An overload chamber 78 is formed in the spool to accommodate a check valve which is generally identified by the reference numeral 80. The check valve 80 includes a ball 82 which is normally urged to a position bearing against a check valve seat 84 by means of a compression spring 86. The check valve seat 84 is formed at one end of the chamber 78. A plug 90 is threadedly mounted in the spool 60 at the other end of the chamber 78. A recess 92 is formed in the housing to accommodate the distal end of the valve portion 72 and an O-ring 94 serves to prevent leakage of hydraulic fluid into the recess 92. A vent opening 96 is formed in the end wall 97 of the recess 92. An aperture 98 is formed in the wall of the spool and the overload flow passage 76 communicates between the overload chamber 78 and the discharge chamber 52 through the aperture 98.

It will be seen that if the hydraulic fluid pressure in the flow control passage 36 exceeds a predetermined pressure, the check valve 80 will be unseated and the overload flow passage 76 will provide a communication between the flow control passage 36 and the discharge passage 52. By providing a large capacity overload flow passage 76, it is possible to reduce the pressure in the flow control passage below a pressure which might otherwise damage the structure of the flow control valve.

A pneumatic actuator 100 is provided for the purposes of moving the spool 62 to and fro between the closed position shown in FIG. 2 and an open position in which it is located a sufficient distance to the right of this position to remove the valve portion 72 from the valve seat 58. The pneumatic actuator consists of a housing 101 in which a cylinder 102 is formed. A piston 104 is slidably mounted in the cylinder 102 and is connected to the spool 62 by means of a shaft 106. An expandable chamber 107 is formed on one side of the piston 104 and an inlet 108 opens into the chamber 107. A compression spring 110 is located between the piston 104 and the end wall 103 of the housing 101. In use, when the system is deactivated, the spring 110 will serve to move the spool to the right of the position shown in FIG. 2 to unseat the valve portion 72 from the bore 60 of the valve seat 58. When the pump is activated and hydraulic fluid is delivered, it will be recirculated to the storage tank when the spool is in the rest position as it will pass from the inlet 38 through the bi-pass passage 54. When the ram is to be extended, the valve 18 directs air pressure to the chamber 107 and thus moves the piston 104 until the spool 62 is located in the piston shown in FIG. 2 in which it serves to direct the hydraulic fluid to the output end 40 of the passage 36. When the ram 40 is to be held in an extended position, the valve 18 is again activated to cut off the supply of air to inlet 108 and the spool will then return to the position shown in FIG. 2, under the influence of the spring 110. When the ram 40 is to be lowered, the valve 18 is again activated to open the return flow control valve 114 as described hereinafter.

The return passage 56 is used to permit the hydraulic fluid which is located downstream of the one-way check valve 42 to return to the fluid storage tank 20 when the ram 14 is to be contracted. The return flow control valve serves to control the lowering or collapsing of the cylinder 14. The return flow control seat 112 is located at one end of the return passage 56. A return flow control valve 114 is formed with a shaft portion 116 which is slidably mounted in a recess 118 which is formed in the housing 34. An enlarged head portion 120 is located at one end of the shaft 116 and is formed with a tapered face 120 which is arranged to bear against the seat 112 to close the return passage 56. A stem 124 projects from the end of the head portion 120 into the return passage 56. A compression spring 126 serves to normally urge the head 120 into engagement with the seat 112. A second pneumatic actuator 128 is provided for the purposes of opening the return flow control valve 114. The second pneumatic actuator 128 includes a cylinder 130 in which a piston 132 is slidably mounted. A shaft 134 extends fromt he piston 132 through a passage 136 and is aligned with the stem 124 of the return flow control valve 114. A compression spring 138 normally serves to space the distal end of the shaft 134 from the stem 124 to allow the return flow control valve 114 to assume its normally closed position. An inlet 140 communicates with the cylinder 130 and serves to communicate with the pneumatic control valve 18 through the pneumatic line 24 such that when the pneumatic control valve 18 is positioned to permit the ram 14 to contract, pneumatic pressure is directed to the cylinder 130 to displace the piston 132 to the left of the position shown in FIG. 2, thereby unseating the head portion 120 to permit the hydraulic fluid to flow through the return passage 56 into the discharge chamber 50 from which it discharges through the discharge passage 50.

As previously indicated, the high pressure hydraulic fluid control valve of FIG. 2 is designed to ensure that the build-up of an overload pressure in the flow control passage system is prevented by incorporating an overload flow passage in the flow control spool which communicates between the flow control passage and the bi-pass passage. A one-way check valve is mounted in the overload flow control passage for movement between a first position closing and a second position opening the overload flow control passage when the hydraulic pressure in the flow control passage exceeds a predetermined level.

In the embodiment illustrated in FIG. 2, the overload flow control passages are proportioned so as to have a sufficient capacity to permit a substantial flow of hydraulic fluid therethrough when the check valve 80 is in its open position. It is contemplated that a high pressure hydraulic flow control valve of the type described above is capable of operating with hydraulic fluid pressures of the order of 1,500 to 2,000 psi.

In a modified high pressure hydraulic control valve illustrated in FIG. 3 of the drawings, like numerals are applied to like parts. The valve illustrated in FIG. 3 of the drawings differs from that illustrated in FIG. 2 of the drawings in the configuration of the flow control spool 62 and the proportions in configuration of the overload flow passage 76. The head portion 64 of the spool has a uniform diameter over its full length and is arranged to fit in a sealing relationship within the bore 60 of the seat 58 in order to close the bi-pass passage 54. In this embodiment, a passage 130 communicates between the overload chamber 78 and the chamber 132 which s formed between the end wall 98 and the adjacent end of the spool 62. The chamber 132 is a sealed chamber and does not have a vent opening 96. The spool 62 has a portion 134 of reduced diameter. It will be understood that despite the larger diameter of the head portion 64, hydraulic fluid can pass freely through the through passage 36 by passing around the head portion 64 through passage arranged on opposite sides of the head portion.

When the pressure in the flow control passage 36 exceeds a predetermined pressure, the ball 82 of the check valve 80 will be unseated to allow hydraulic fluid to pass through the overflow passage 76 into the overflow chamber 78. Hydraulic fluid will then pass from the chamber 78 through the passage 130 into the chamber 132. When the hydraulic pressure builds up in the chamber 132, the spool 62 will be moved to the left from the position shown in FIG. 3 and when the shoulder 135 is moved to the left of the seat 58, the bi-pass passage 54 will open to permit the hydraulic fluid to pass through the bore 60 into the discharge chamber 52. In this embodiment, the passage 98a is a very small diameter bleed passage which merely serves to bleed fluid from the chamber 78 when the ball 82 of the check valve returns to its closed position to permit the spool 62 to return to its original position shown in FIG. 3 in which the bi-pass passage 54 is closed. In this embodiment, the overload pressure is used to move the spool to the position in which it opens the bi-pass passage 54.

In a further modification which is illustrated in FIG. 4 of the drawings, the check valve 80 has been redesigned. The spool 62 is substantially the same as the spool illustrated in FIG. 2 of the drawings with the exception that the seat 184 is formed on a lip 186 (FIG. 5). The ball 82 is replaced by a sleeve 182 which is slidably mounted on a shaft 185. A compression spring 188 normally urges the sleeve 182 to a position in which it bears against the seat 184. It will be noted that a diameter D1 of the overload flow passage 76 is greater than the diameter D2 of the shaft 185. As a result, the difference in the area at the exposed end face 190 of the sleeve 182 and the area of the end face 192 of the shaft 185, the pressure in the overload flow passage 76 can be utilized to cause the sleeve 182 to move to the open position when this pressure exceeds a predetermined level.

Figure 6:
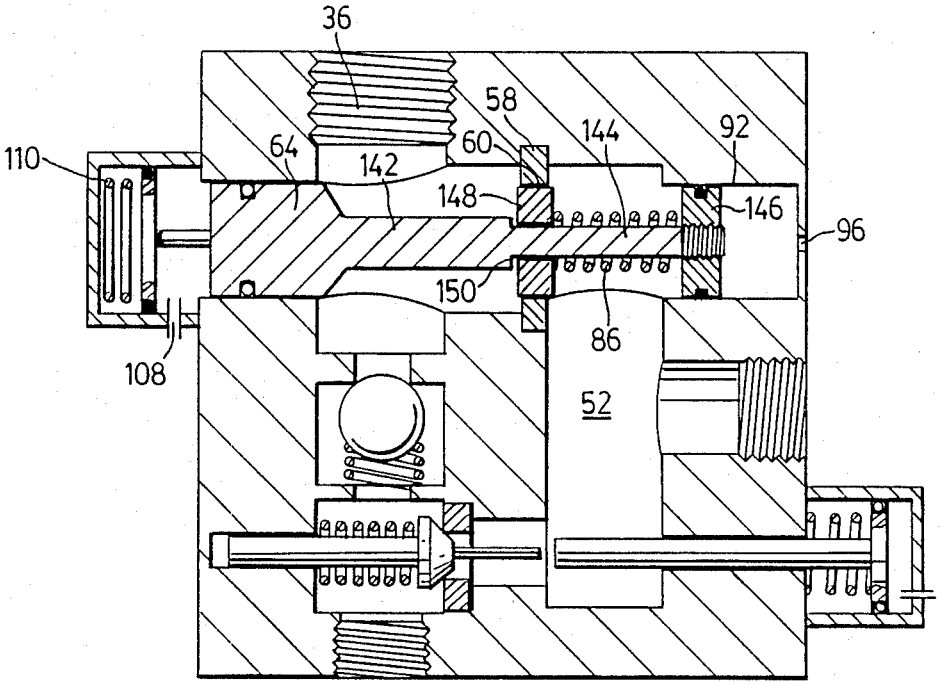

A further modification of the flow control spool is illustrated in FIG. 6 of the drawings. In this embodiment, the flow control spool is not formed with an overload flow passage such as the passage 76 of FIG. 4. In this embodiment, the spool has a shaft portion 142 which extends from the head portion 64 and an extension 144 of reduced diameter which extends from the shaft portion 142. The extension 142 is threadedly mounted in a piston 146 which is slidably mounted in the recess 92. A flow control valve 148 is provided in the form of a collar which is slidably mounted on the shaft 144 in a close fitting, sealed sliding relationship. The collar 148 is proportioned to fit in a close fitting sealed sliding relationship within the bore 60 of the flow control valve seat 58. The compression spring 86 serves to urge the collar 148 to a position in which it bears against the shoulder 150 which is formed at the reduction between the diameter of the shaft 142 and the diameter of the stem 144 and in this position it functions as a normal spool.

It will be noted that the diameter D1 of the head portion 64 is greater than the diameter D2 of the extension portion 144. As a result, when the pressure in the flow control passage 36 exceeds a predetermined pressure, the collar 148 will move to the right of the position shown in FIG. 6 to compress the spring 86 and to move to the right of the valve seat 58. As a result, the fluid in the passage 36 will discharge from the passage 36 through the bore 60 into the return chamber 52 to relieve the overload pressure condition.

Figure 7:
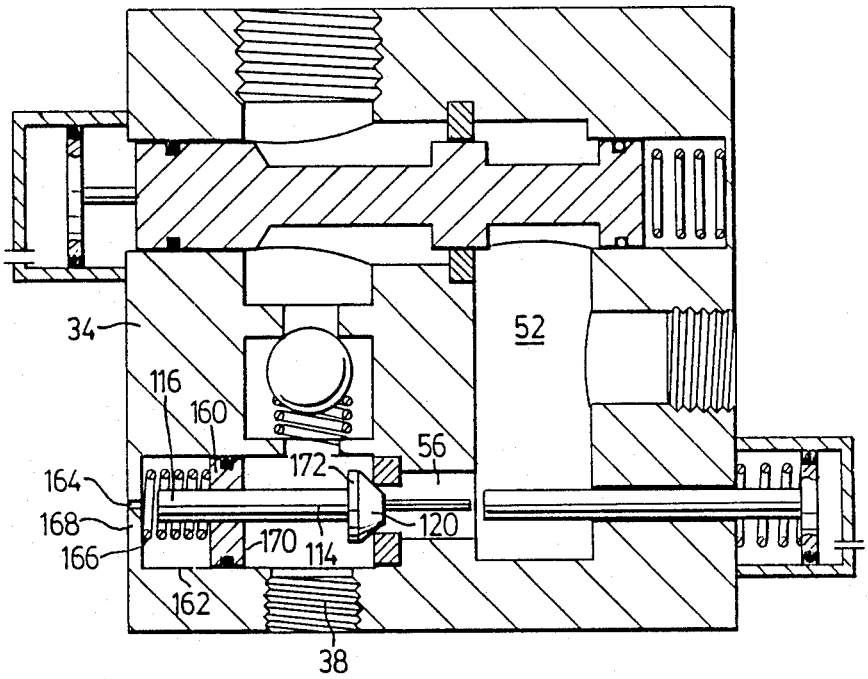

In a further embodiment illustrated in FIG. 7 of the drawings, the overload pressure condition is overcome by means of the return flow control valve 114. In this embodiment, the return flow control valve has a collar 160 mounted on and held fast with respect to the shaft 116. The collar 160 is slidably mounted in a chamber 162 formed in the housing 34. A vent passage 164 opens from the chamber 162. A compression spring 166 extends between the collar 160 and the end wall 168 of the chamber 162. In use, because of the difference in cross-sectional area of the end face 170 of the collar 160 and the end face 172 of the head portion 120, excessive pressure in the flow control passage 38 will result in movement of the collar 160 toward the end wall 168 to compress the spring 166 and this in turn will move the head portion 120 to the open position shown in FIG. 7. As a result, the high pressure hydraulic fluid in the passage 38 will discharge through the return passage 56 into the return chamber 52.

A further embodiment of the present invention is illustrated in FIG. 8 of the drawings in which the spool 62 is formed with a cylindrical head portion 200, a flow control stem 202, a short shaft portion 204 and a piston head portion 206. The stem portion 202 is arranged to extend into sealing engagement with the flow control seat 58 to function as the flow control valve. The shoulder 208 which extends between the stem portion 202 and the shaft 204 will move from the position shown in FIG. 8 to a position to the left of the valve seat 58 to open the bi-pass passage 54.

A pneumatic actuator 210 comprises a housing 212 in which a piston 214 is slidably mounted. A pneumatic expansion chamber 216 is formed between the piston 214 and the end wall 218 of the housing. An input passage 220 opens into the chamber 216. A compression spring 222 extends between the piston 214 and the end face of the head portion 200 of the spool 62. In use, by reason of the fact that the diameter D1 of the head portion 200 is greater than the diameter D2 of the head portion, it follows that a cross-sectional area of the head portion 200 is greater than the cross-sectional area of the stem portion 202. Consequently, when the pressure in the flow control passage 36 exceeds a predetermined control pressure, the spool 62 will be deflected to the left of the position shown in FIG. 8 to compress the spring 222 until the bi-pass passage 54 opens.

In this embodiment, it is important to ensure that the spring force applied by the spring 222 is less than the load applied to the pistion 214 by the pressure of the air in the chamber 216.

A vent opening 224 is formed in the end wall 226 to vent the chamber 228 to permit free movement of the piston 206.

In normal operation, the spool 62 will assume an open position to the left of that shown in FIG. 8 such that the bi-pass passage 54 will be open when the hoist 14 is in its lowered position so that if the pump is running, hydraulic fluid will circulate through the passage 36 and bi-pass passage 54 into the return chamber 52 and will be directed through the discharge passage 50 to return to the storage tank 20. When it is necessary to power the ram 14, the valve 18 is activated to supply air pressure to the chamber 216 through the inlet 220. This will move the piston 214 to the right in relation to FIG. 8 to move the spool 62 to the position shown in FIG. 8 enclosing the bi-pass passage 54. The spool 62 will remain in this position until such time as the pressure in the through passage 36 exceeds a poredetermined pressure at wjhichtime the spool 62 will then move to the left from the position shown in FIG. 8 until the bi-pass passage 54 is again opened. This will occur as a result of the difference in cross-sectional area of the head portions 200 and the stem portion 202 when the condition exists that the pressure in the chamber 36( (P1) times the area differential is greater than the pressure applied by the spring 222. When the pressure in the flow control passage 36 drops below the critical pressure, the spring 22 will serve to relocate the spool in the position shown in FIG. 8. When the pneumatic valve 18 is relocated to the position signalling that the ram is to be held in an extended position or lowered, the pneumatic pressure applied to the chamber 216 will relieved and the piston 214 will move to the left of the position in which it is shown in FIG. 8 to again allow the spool 62 to move to the left to open the bi-pass passage 54.

A still further embodiment is illustrated in FIG. 9 of the drawings wherein the spool 62 is formed with a head portion 240, a shaft portion 242, a valve closure flange 244 and a piston 246. In normal use, the spool 62 will assume the position shown in FIG. 9 when the pneumatic actuator 248 is positioned to indicate that hydraulic fluid should be directed through the passage 36 to power the ram of the lift truck. An overload passage 250 is formed in the housing 34 and extends from the through passage 36 from a point upstream of the check valve 42 into a chamber 252 in which a check valve 254 is located. The check valve 254 consists of a ball 256 and a spring 258. A passage 260 extends from the chamber 252 into the chamber 262 which is formed behind the piston 246.

When the pressure in the through passage 36 exceeds the predetermined control pressure, the ball 256 of the check valve 252 will be unseated and hydraulic fluid will pass through the passage 250, chamber 254 and passage 260 into the chamber 262. The pressure in the chamber 262 will serve to deflect the spool 62 to the left from the position shown in FIG. 9 to unseat the flange 244 from the bi-pass passage 54 thereby opening the bi-pass passage 54 to permit the fluid to pass therethrough into the return chamber 52. A small bleed passage 264 extends from the chamber 262 into the return chamber 52. This bleed passage 264 is not sufficiently large in diameter to prevent a buildup of pressure in the chamber 262. The passage 264 is merely a bleed passage which will serve to slowly bleed off the hydraulic fluid into the return chamber 52 to permit the spool to return to the closed position when the pressure in the through passage 36 drops below the critical pressure.

FIG. 10 of the drawings illustrates a further embodiment of the present invention in which the principal feature is the manner in which the flow control valve seat 58 and the return valve seat 115 are mounted in the housing 34. The housing 34 is a die-cast housing in which a passage 270 extends inwardly from the end face 272 to a seating shoulder 274. The flow control valve seat 58 is propotioned to fit in the passage 270 and bears against the shoulder 274. The O-ring 276 serves to seal the seat 58 against the side wall of the passage 270. A retaining member 278 is provided for the purposes of retaining the hardened seat 58 in its operable position bearing against the shoulder 74. The retaining member 274 comprises a tubular sleeve 280 and an end mounting flange 282. The tubular sleeve 280 extends into the access passage 270 to locate its inner end 284 in a position bearing against the seat 58. The flange portion 282 is clamped to the housing 34 by means of a plurality of mounting screws 286 (one one of which is shown).

The recess 270 and shoulder 274 are formed in the die-casting operation and do not require further machining in order to accommodate the seat 58. The seat 58 is made from a hard wear-resistant material. By mounting the hardened seat 58 in this manner, it is possible to incorporate a hardened valve seat into a die-cast valve body. This method of mounting the seat is particularly suitable for use in applications where the spool of the valve is mounted to reciprocate through the bore of the seat because in such an application, the seat is subjected to pressure from opposite sides and must therefore be retained against movement in both directions.

In an application where the hardened seat is only subjected to pressure from one side, such as the hardened seat 115 which is located in the return passage 56, it is not necessary to provide a retaining sleeve. In this structure, the mounting passage 290 extends inwardly from the end face 292 to the shoulder 294. Again, this mounting passage is formed in the die-casting operation. The hardened seat 115 is inserted into the passage and seated so that it will bear against the shoulder 294. In this installation, the hardened seat 115 is proportioned to provide an interference fit within the passage 292 and this interference fit serves to normally retain the seat 115 in the position in which it bears against the shoulder 294. Again it will be seen, that this permits a hardened seat to be mounted in a die-cast housing without requiring the site in which it is mounted to be a machined site.

It will be understood that the drawings are intended to diagrammatically illustrate the structure of the valve and are not intended to provide all of the engineering detail. For example, it will be apparent that removable plugs must be provided for the purposes of mounting and removing the ball 44 and seat 46.

These and other modifications of the present invention will be apparent to those skilled in the art without departing from the scope of the invention.

We claim:

1. A high pressure hydraulic flow control valve comprising, a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, an overload flow passage opening through said flow control spool and having a first end communicating with said flow control passage and a second end communicating with said bi-pass passage, a second one-way check valve mounted in said overload flow control passage of said flow control spool for movement between a first position closing and a second position opening said overload flow control passage such that when the hydraulic pressure in said flow control passage exceeds a predetermined level, the second one-way check valve will move to its open position to allow the hydraulic fluid to flow from the fluid control passage to the return passage through the overload flow passage.

2. A high pressure hydraulic flow control valve comprising, a valve housing, a flow control passage opening through said housing, said flow control passage having an input end and an output end, a first one-way check valve in said flow control passage for limiting the direction of flow through said flow control passage to flow in a stream from the input end to the output end, discharge passage means opening from said housing, a bi-pass passage communicating between the flow control passage and the discharge passage, a flow control seat in said bi-pass passage, a flow control spool slidably mounted in said bi-pass passage, a flow control valve carried by said flow control spool for movement between a first position in which it cooperates with said flow control seat to close and a second position in which it cooperates with said flow control seat to open said bi-pass passage, first pneumatic control means cooperating with said flow control spool to move it to and fro between its first and second positions, return passage means communicating between the flow control passage and the discharge passage downstream of the first one-way check valve, a return flow control seat in said return passage, a return flow control valve slidably mounted in said return flow control passage for movement between a first position in which it cooperates with said return flow control seat to open and a second position in which it cooperates with said return flow control seat to close said return flow passage, second pneumatic control means cooperating with said return flow control valve to move it to and fro between its first and second positions, an overflow chamber in said spool, an overflow passage extending through said spool and having an input end communicating with said flow control passage and an output end communicating with said overload chamber, a discharge passage opening from said overload chamber to said return passage, said output end of said overload passage having a first cross-sectional area (A1), an overload valve in said overload chamber comprising:

(i) a guide shaft which is aligned with and spaced from the output end of said overload passage, said guide shaft having a second cross-sectional area (A2) which is less than the first cross-sectional area (A1), (ii) a sleeve member having a bore extending therethrough, said sleeve member being mounted on and extending radially from said guide shaft to provide a combined cross-sectional area which is greater than said first cross-sectional area (A1), said guide shaft slidably supporting said sleeve member in a sealed relationship for movement thereon between a first position in which it cooperates with the guide shaft to close the output end of the overload passage and a second position in which it is spaced from the output end of the overload passage to permit flow through the overload passage, (iii) spring means in said chamber normally urging said sleeve to its first position until the pressure in the flow control passage is sufficient to apply a load to the sleeve which is sufficient to cause it to move from said first position to said second position to open the overload passage into the overload chamber.

* * * * *